United States Patent [19]

Sengewald

[11] Patent Number: 4,738,546

[45] Date of Patent: Apr. 19, 1988

[54] PACKAGE BAG AND METHOD OF MANUFACTURING THE SAME

[76] Inventor: Karl H. Sengewald, Kreisstrasse 16, 4802 Halle in Westfalen, Fed. Rep. of Germany

[21] Appl. No.: 849,209

[22] Filed: Apr. 7, 1986

[30] Foreign Application Priority Data

Apr. 6, 1985 [DE] Fed. Rep. of Germany ..... 3512597

[51] Int. Cl.[4] ..... B65D 33/10

[52] U.S. Cl. ..... 383/7; 383/8; 383/120

[58] Field of Search ..... 383/25, 7, 8, 105, 109, 383/110, 119, 120; 229/180

[56] References Cited

U.S. PATENT DOCUMENTS

| | | | |
|---|---|---|---|
| 3,208,492 | 9/1965 | Braithwaite | 383/8 |
| 3,468,470 | 9/1969 | Sengewald | 383/120 |
| 3,568,918 | 3/1971 | Blomquist | 383/109 |
| 3,896,991 | 7/1975 | Kozlowski et al. | 383/119 |

FOREIGN PATENT DOCUMENTS

| | | | |
|---|---|---|---|
| 1045918 | 12/1953 | France | 383/109 |

*Primary Examiner*—Willis Little

*Attorney, Agent, or Firm*—Michael J. Striker

[57] ABSTRACT

A package bag of a box-like shape has folded sides and the front and upper walls provided with reinforcement layers. The bag is formed of thermoplastic film. Each reinforcement extends predominantly over the entire flat of the front and back wall whereby a stiff structure results.

3 Claims, 4 Drawing Sheets

PACKAGE BAG AND METHOD OF MANUFACTURING THE SAME

BACKGROUND OF THE INVENTION

The present invention relates to a bag to be carried which is formed as a package and made of thermoplastic film.

The bag of the type under discussion has folds at opposite sides and when closed and filled with commodity takes a parallelepiped shape.

Packages with a grip can have any applications. Such packages can be used, for example as packages for napkins. With such products with a rigid or substantially rigid shape, which products in addition should be in a stack, packages are provided with folds either at the opposite side walls or at the upper and bottom walls so that a package is shaped as a box when filled. The flats particularly of the front wall and back wall of such packages are often uneven whereby incriptions on the package can be distorted. In order to enhance rigidity of the box-like packages it has been proposed to make packages of reinforced film or foil material. This reinforced film or foil material can be obtained by a respective hardness or a respective thickness. In both cases however, the manufacturing of the packages becomes rather difficult. More rigid or thicker film material is difficult to fold in film or foil-processing machines. The producing of folds at two opposite longitudinal sides is difficult in both instances. Welding of the layer of thicker film material takes longer time. Higher costs are also involved.

SUMMARY OF THE INVENTION

It is an object of the present invention to provide an improved package bag.

It is another object of the present invention to provide a package bag which is easy to manufacture and which when filled would have the smooth front and back walls.

These and other objects of the present invention are attained by a package bag of thermoplastic synthetic film, comprising a front wall, a back wall and two opposite walls formed with folds, said bag after being closed and filled assuming the shape of parallelepiped, the improvement comprising a first reinforcement extended predominantly over a surface of said front wall and a second reinforcement extended predominantly over a surface of said back wall.

Due to the invention the front and back walls of the package would be provided with reinforcements and thereby the remaining surfaces of the package would be also stiffened, which is advantageous.

The front and back walls are stiff to the same degree so that when the package is closed and filled the front and back walls are evenly smooth. Since the reinforcements extend substantially over the entire surfaces or flats of the front and back walls a parallelipped shape of the package results.

Inasmuch as the reinforcements themselves are not folded they can have good rigidity. It is also possible to make reinforcements of thin-walled, pressed and stiff carboard or stiff paper.

Thin stiff plastics is also utilized.

The appearance of the box-like packages and their stiffness are substantially improved as well as their rigidity.

The bag according to the invention requires small material comsumption.

Each reinforcement may be formed on an inner side of the package.

The first and second reinforcement may be made of nonflexible synthetic film.

The folds may be provided at side walls of the bag which further includes a grip which is limited by two transverse weld seams spaced from each other. Thereby the force exerted on the grip in use of the bag is transmitted to and distributed over the substantially large surfaces of the bag.

The folds may be provided at a bottom wall and an upper wall; the bag may further include a grip overlapping the folds and being connected at one end thereof to said front wall and at the other end thereof to said back wall at an upper regions thereof.

The distribution of the force exerted on the grip of the bag in this embodiment is also favorable because the weld seams used for the connection form an immediate bridge between the grip and the reinforcements.

Each wall of the bag may be formed of two layers of thermoplastic film connected to each other by backing glue, a reinforcement being arranged between said two layers. Such a structure of the bag is particularly rigid. Since the film layers are connected to each other by glueing the glue can be applied to the film layers and/or to the reinforcements, and the displacement of the reinforcements on the film layer is prevented because the backed glue which connects the film layers to each other provides for a sufficient bonding even during a further treatment of the bags.

The objects of the present invention are also attained by a method of producing package bags, which comprises the steps of providing a flat tape of thermoplastic film, positioning on said tape of rectangular reinforcements in two rows at a lateral distance from each other, connecting said reinforcements to said tape by backed glueing; folding the flat tape over in the middle between said rows into a half-hose; providing side folds; connecting free edges of the half-hose to each other by welding to form a hose; and dividing the hose into bags by transverse weld seams and cuts produced between adjacent reinforcements positioned in the direction of elongation of the hose.

The method according to the invention ensures that the reinforcements are not folded, but the folding of the film or the both film layers is carried out between the reinforced film layers.

Two rows of the reinforcements may be applied to said tape in an offset position relative to a central axis of said tape.

The reinforcements may be firstly applied to the flat tape and thereafter a further flat tape is laid on said flat tape with the reinforcements thereon, said flat tapes being connected to each other by backed glue.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
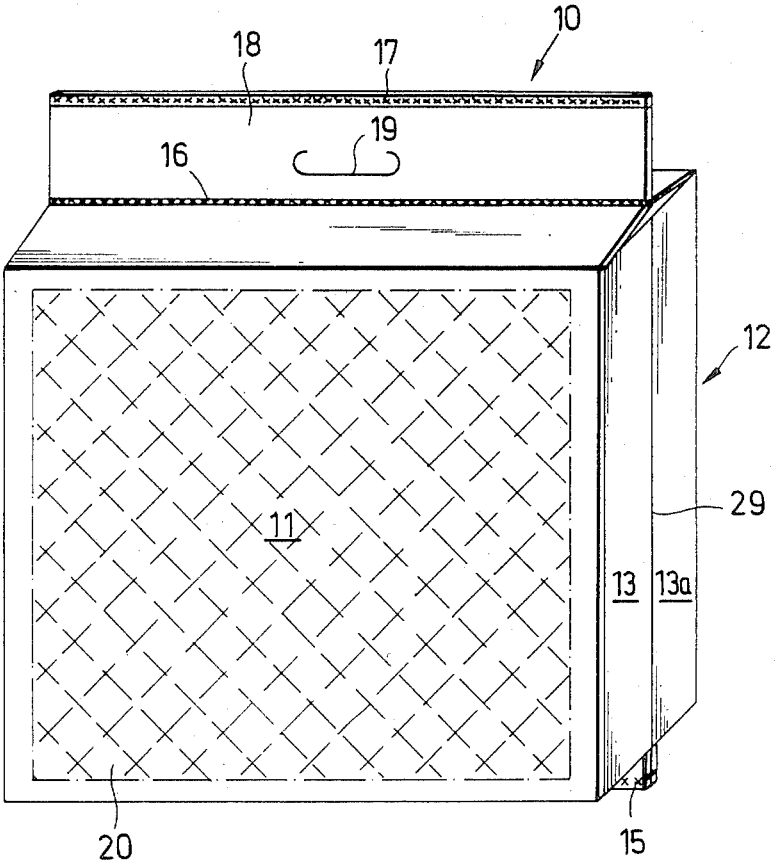
FIG. 1 is a perspective view of a package bag with side folds, according to the invention.

Referring now to the drawings in detail it will be seen that FIG. 1 shows a bag formed as a package 10 of a thermoplastic synthetic film.

Bag 10 has a front side 11 and a rear side 12. The bag which is holdable has at two opposing side folds 13, 13*a* and 14, 14*a* which are produced from the hose shown in FIG. 9. The side folds are formed in the embodiments of the bags shown in FIGS. 10 and 11. The bag manufactured and filled with a commodity has a bottom weld seam 15 and two transversely-extending weld seams 16 and 17 which limit a carrying grip 18 with a stamped-out grip opening 19.

The front side 11 and the back side 12 are reinforced with reinforcement layers 20 shown by crossed dashed lines.

Figure 2:
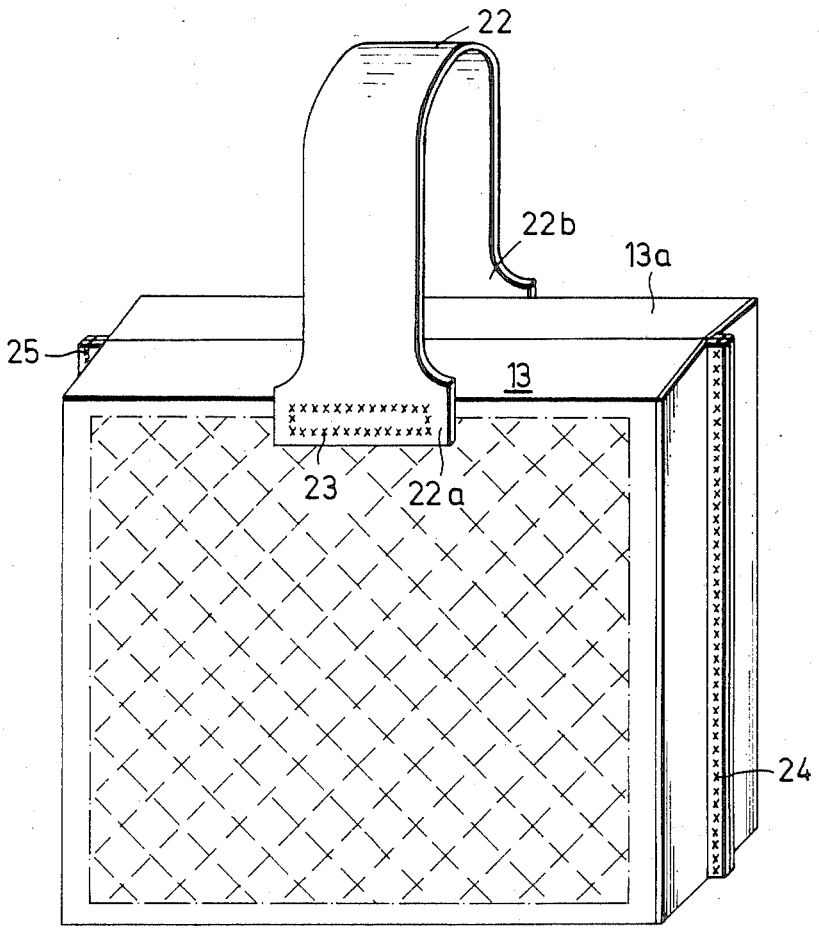
FIG. 2 is a perspective view of a package bag with bottom folds and upper folds.

The holdable bag according to FIG. 2 has bottom folds 13, 13*a* as well as a grip 22 which is formed as a loop, whereby the grip end 22*b* is connected by a respective weld seam with the back side of the bag.

The weld connection is advantageous in such a way that it extends in the synthetic film or a thin synthetic plate in case of the reinforcement made of synthetic plastic material so that an immediate connection between the loop-shaped grip 22 formed of plastic film and the reinforcement plate or reinforcement film made of weldable plastic or weldable plastic coating is provided.

The bag according to FIG. 2 has during the manufacturing of the bag a transversal weld seam 24 and then is provided, after the bag has been filled, with a transverse weld seam 25 formed as a closing seam.

Figure 3:
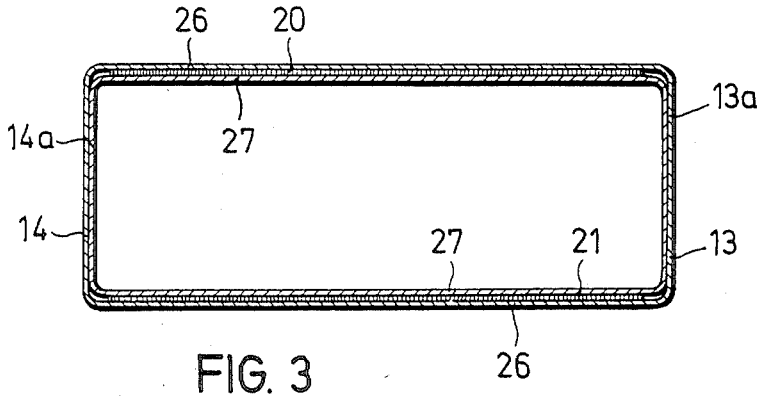
FIG. 3 is a cross-section view through the middle of the package bag of FIG. 1.

FIG. 3 shows a horizontal section along the middle of the bag of FIG. 1. The bag is comprised of a combined film, e.g. an outer layer 26 of polyethylene and an inner layer 27, also of polyethylene. The bag can be also made of other plastics. Both film layers are connected to each other by a backed adhesive. At the front side and the back side between the outer layer 26 and the inner layer 27, reinforcement inserts or layers 20 and 21 are provided.

Figure 4:
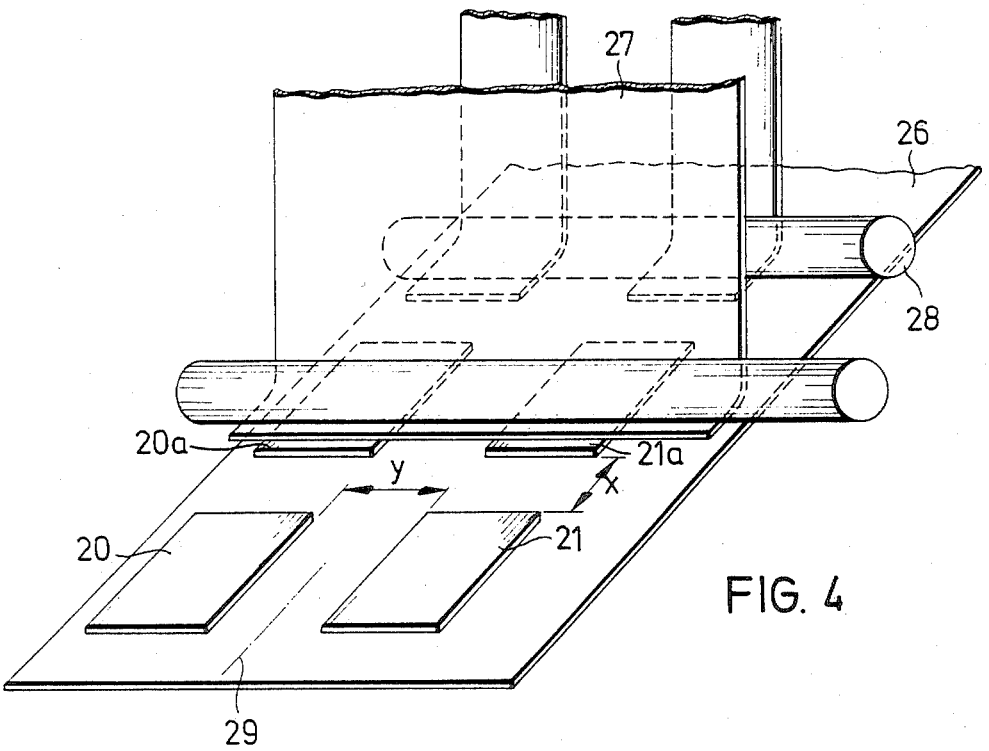
FIG. 4 is a schematic view of the application of reinforcing filling layers onto a film tape or between two film tapes.

FIG. 4 illustrates a step of manufacturing of the bag. As seen in FIG. 4, reinforcement strips 20 and 21 are applied onto a flat tape 26 guided over deflecting rollers 28. The reinforcement strips themselves are made of a tape by cutting the same into strips of a predetermined length by means of a non-shown cutting device, and it is ensured that the reinforcement strips are spaced from each other by distance X in FIG. 4, which distance depends on the depths of the side folds 13, 13*a* shown in FIG. 1. The whole depth of the both side folds defines the width of the package. The distance X also depends upon the height of the holding grip or, in other words upon the distance between transverse welds 16 and 17.

The rectangular reinforcement strips 20 and 21 are not only arranged at the distance X from each other but also in two rows spaced from each other by a distance Y. This distance Y is selected in accordance with the depth of both side folds 13, 13*a*, the common fold line 29 (FIG. 4) of which is shown by a dashed line; the fold line defining how to fold the flat tape 26 to form a half-hose as will be explained below with reference to FIG. 8.

Onto the flat tape provided with reinforcement strips 20 and 21, is applied a flat tape 27 guided over a deflecting roller 30. Tape 27 is applied to that side of the tape 26 which is provided with a backed adhesive. It is advantageous to coat the upper side of tape 26 with the backed adhesive so that both tapes are glued to each other. The adhesive material of these tapes is also utilized for glueing reinforcement strips 20 and 21 which may or may not be coated with adhesive.

Figure 5:
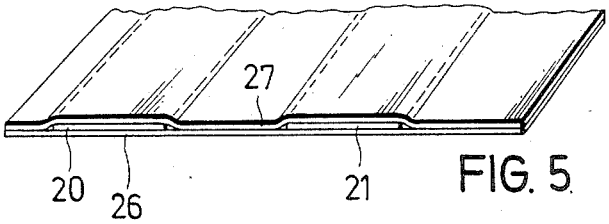
FIG. 5 is a partial view of the film produced by the arrangement shown in FIG. 4.

FIG. 5 shows a portion of the blank formed of two layers of the film with the reinforcement strips intergrated therein.

Figure 6:
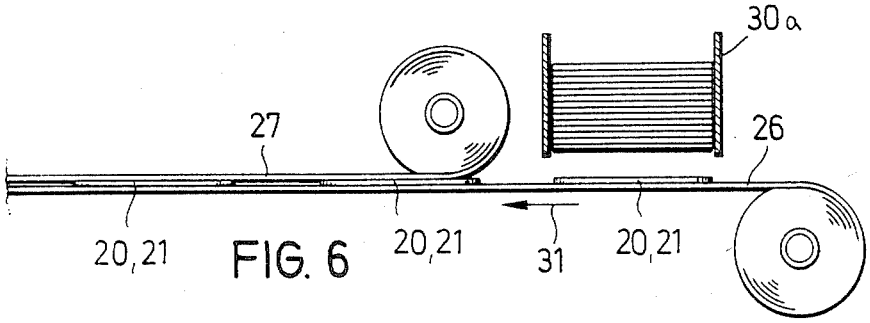
FIG. 6 is a schematic view of the modified arrangement for the application of reinforcing layers.

FIG. 6 illustrates that the reinforcement strips are applied onto the moving tape 26 as prepared strips from a magazine 30*a*. Tape 26 is moved in the direction of arrow 31. The upper tape or film 27 is applied onto reinforcement strips 20, 21 positioned on and glued to the tape 26.

Referring back to FIG. 4 it will be seen that both rows of strips 20 and 20*a* of one row and 21, 21*a* of the other row are offset relative to the central axis of elongation of both tapes 26, 27.

Figure 7:
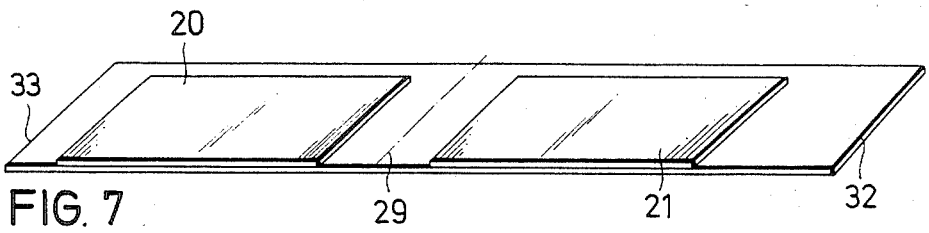
FIG. 7 is a perspective view of the film tape with reinforcing layers glued thereto.
Figure 8:
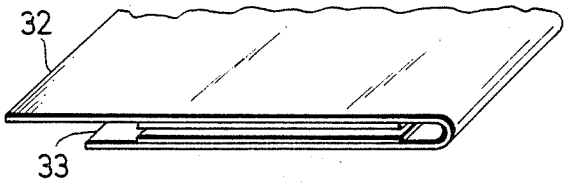
FIG. 8 is a portion of the folded film tape.

As clearly seen in FIG. 7 strips 21 have a greater distance from edge 32 than strips 20 from the edge 33. Accordingly the fold line 29 at which the flat tape is folded is offset relative to the central axis of the tapes 26 and 27 so that edge 32 projects beyond edge 33 in the folded condition as shown in FIG. 8. At the right-hand part the side folds 13 and 13*a* are formed while at the protruding left-hand side, folds 14 and 14*a* are formed when edges 32 and 33 are brought into alignment. Finally the longitudinal weld seam 34 of the half-hose forms the latter into a hose.

Figure 10:
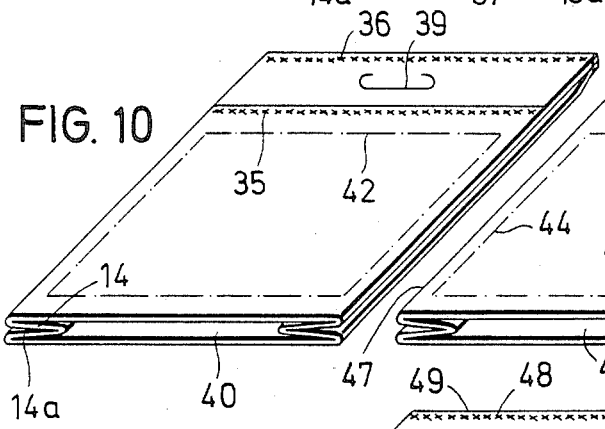
FIG. 10 is a perspective view of the bag made of the hose of FIG. 9.
Figure 11:
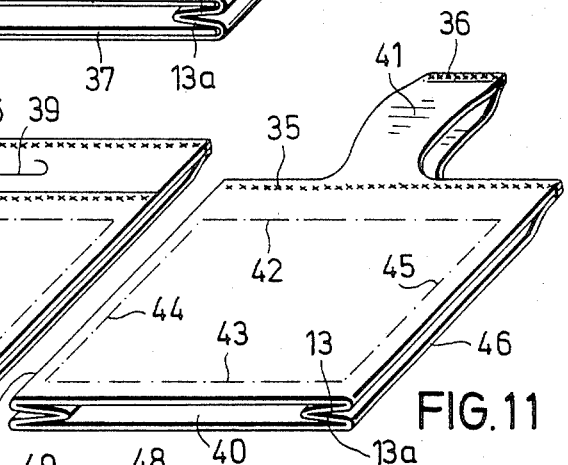
FIG. 11 is a perspective view of the modified bag formed of the hose of FIG. 9.

In order to produce carrying bags according to FIGS. 10 and 11, two weld seams 35 and 36 are provided at a distance Z from each other; these seams connect two opposite walls 37 and 38 of the hose to each other. A stamped-out gripping opening 39 is made between two welds. A filling opening is denoted by reference numeral 40.

FIG. 11 shows a modified embodiment in which a greater distance between transversal weld connections 35 and 36 is provided and a gripping loop 41 is formed. Filling opening 40 is also made at the bottom of the bag.

The contour of the reinforcement layer is shown by dash-dotted line. As seen in the drawings the upper edge 42 is spaced from the weld seam 35 by the distance which corresponds to the depth of the fold 13. The lower edge 43 is also spaced from the edge forming the filling opening 40 respectively so that after the filling of the bag and providing thereat of the transverse weld seam 15 (FIG. 1) the bottom of the bag is formed.

Lateral edges 44 and 45 extend approximately to the longitudinal edges at which the front side merges into the respective side folds 13 and 14.

Figure 9:
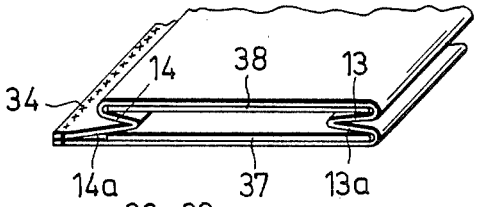
FIG. 9 is a partial perspective view of the hose with the side folds.
Figure 12:
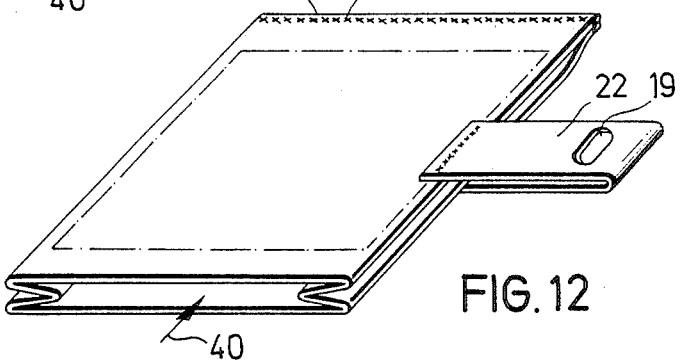
FIG. 12 is a further modification of the bag made of the hose of FIG. 9.

FIG. 12 depicts a further modification of the bag which is formed of the hose shown in FIG. 9. A transverse weld seam 48 formed with a separation perforation 49 is provided at the hose. Filling opening 40 is formed at the side of the bag. A U-shaped folded strip 22 forms the grip. The latter is provided with a grip opening 19 which is stamped-out. A stamping in place of the opening can be provided in the strip 22. The weld seam closes the filling opening 40 after the bag has been filled. The bag of FIG. 12 thus has bottom folds and upper folds.

It will be understood that each of the elements described above, or two or more together, may also find a useful application in other types of package bags differing from the types described above.

While the invention has been illustrated and described as embodied in a package bag, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing package bags including a front wall, a back wall and two opposite walls formed with folds, said bag after being closed and filled, assuming the shape of parallelepiped, a first reinforcement extended predominantly over surface of said front wall and a second reinforcement extended predominantly over a surface of said back wall, the method comprising the steps of providing a flat tape of thermoplastic film, positioning on said tape of rectangular reinforcements in two rows at a lateral distance from each other; connecting said reinforcements to said tape by backed glueing; folding the flat tape over in the middle between said rows into a half-hose; providing side folds; connecting free edges of the half-hose to each other by welding to form a hose; and dividing the hose into bags by transverse weld seams and cuts produced between adjacent reinforcements positioned in the direction of elongation of the hose.

2. The method as defined in claim 1, wherein two rows of said reinforcements are applied to said tape in an offset position relative to a central axis of said tape.

3. The method as defined in claim 1, wherein said reinforcements are firstly applied to the flat tape and thereafter a further flat tape is laid on said flat tape with the reinforcements thereon, said flat tapes being connected to each other by backed glue.

* * * * *